US006026821A

United States Patent [19]

Last

[11] Patent Number: 6,026,821

[45] Date of Patent: Feb. 22, 2000

[54] METHOD OF AND HAIR DRYER FOR DRYING HAIR USING REMOTE SENSING OF THE MOISTURE CONTENT OF THE HAIR

[75] Inventor: Frits Last, Drachten, Netherlands

[73] Assignee: U.S. Phillips Corporation, New York, N.Y.

[21] Appl. No.: 09/192,705

[22] Filed: Nov. 16, 1998

[30] Foreign Application Priority Data

Nov. 21, 1997 [EP] European Pat. Off. ..... 97203646

[51] Int. Cl.[7] ..... A45D 24/00; A45D 7/06; A45D 7/02

[52] U.S. Cl. ..... 132/200; 132/206; 132/211

[58] Field of Search ..... 132/200, 206, 132/211

[56] References Cited

U.S. PATENT DOCUMENTS

| | | | |
|---|---|---|---|
| 4,424,437 | 1/1984 | Walter et al. | 219/364 |
| 4,595,838 | 6/1986 | Kerschgens | 250/504 R |
| 5,636,318 | 6/1997 | Polaert et al. | 392/380 |
| 5,857,379 | 1/1999 | Lulofs et al. | 73/73 |

FOREIGN PATENT DOCUMENTS

| | | |
|---|---|---|
| 0679350A1 | 11/1995 | European Pat. Off. . |
| 3433246C2 | 3/1986 | Germany . |
| 97/09898 | 3/1997 | WIPO . |

*Primary Examiner*—John J. Wilson
*Assistant Examiner*—Robyn K. Doan
*Attorney, Agent, or Firm*—Ernestine C. Bartlett

[57] ABSTRACT

Hair dryer with remote sensing of the moistness of the hair by means of a detector which compares the amount of radiant energy in two absorption bands in the spectrum of light emitted by an infra red source and reflected by the hair. One of the absorption bands is caused by water in the hair. The amount of radiant energy in this absorption band changes significantly during the drying of the hair. The other absorption band is caused by keratin in the hair. The energy in this band changes to a much smaller extent during the drying of the hair. The intensity ratio of the two bands is an indicator for the moistness of the hair and can be employed to control the temperature and/or the air flow of the hair dryer.

12 Claims, 3 Drawing Sheets

METHOD OF AND HAIR DRYER FOR DRYING HAIR USING REMOTE SENSING OF THE MOISTURE CONTENT OF THE HAIR

BACKGROUND OF THE INVENTION

The invention relates to a method of drying hair by supplying hot air, using remote sensing of the moisture content of the hair.

The invention also relates to a hair dryer including means for supplying a stream of hot air for drying moist hair and means for the remote sensing of the moisture content of the hair.

Such a method and hair dryer are known from Patentschrift DE 34 33 246. During hair drying there is always a risk that the hair is made too dry by the hot air from the hair dryer, as a result of which the hair is liable to be damaged. The temperature increases rapidly where the hair has dried, which is detrimental to the hair and painful for the scalp. For a satisfactory and comfortable result it is therefore important to know how much moisture is left in the hair and to take steps if the moisture content decreases below a given limit. In the known hair dryer the moisture content is measured by means of a moisture sensor disposed in the circulating air stream in a hair-drying hood. The measurement of the moisture content of the hair is then measured remote from the hair but is limited to hair-drying hoods in which the hot air circulates. However, this known method of moisture measurement cannot be used in the case of hand-held hair-dryers because in these dryers no hot air circulates within an enclosed space.

Furthermore, hair dryers are known, for example from International Application WO 97/09898, which have electrodes arranged on an accessory which comes into contact with the hair during drying. By means of the electrodes the moistness of the hair is measured on the basis of the resistance or capacitance of the hair between the electrodes. However, in this type of dryer the measurement of the moistness of the hair is not effected at a distance and has therefore only a limited field of use.

From the Demande de brevet europeen EP 0 679 350 a hair dryer is known in which the temperature of the hair to be dried is measured in a contactless manner, at a distance from the hair, by means of an infrared sensor arranged on the housing of the hair dryer. The temperature of the hair is then determined on the basis of the infrared radiation emitted by the hair. However, the temperature of the hair is only an indirect indication of the moisture content of the hair and is consequently less reliable.

SUMMARY OF THE INVENTION

Therefore, there is a need for hair dryers and methods of drying moist hair using remote sensing of the moisture content of the hair. To this end, according to the present invention, the method of the type defined in the introductory part is characterized in that amounts of radiation energy in at least one absorption band of radiation reflected from the hair are measured, the at least one absorption band being caused by moisture in the hair and the change of the amount of radiation energy in the at least one absorption band being used as a measure of the moisture content, and the stream of hot air is controlled in response to the change. The hair dryer includes means for supplying a stream of hot air for drying moist hair and means for the remote sensing of the moisture content of the hair and it dryer comprises: means for measuring amounts of radiation energy in at least one absorption band of radiation reflected from the hair, the at least one absorption band being caused by moisture in the hair, means for determining the change of the amount of radiation energy in the at least one absorption band, and means for controlling the stream of hot air in response to the change.

The amount of moisture in the hair is determined in that the amount of radiation in an absorption band specific to water is measured during the drying process. The amount of radiation in said absorption band reflected from the hair changes as the hair becomes dryer. By measuring the radiation at given intervals it is possible to predict when the hair will be dry.

A more accurate measurement result is obtained by a variant of the method which is characterized in that amounts of radiation energy in at least two absorption bands of radiation reflected from the hair are compared with one another, one of the absorption bands being caused by moisture in the hair and another one of the absorption bands being caused by a moisture-independent characteristic of the hair, the ratio between the amounts of radiation energy in the at least two absorption bands being used as a measure of the moisture content, and the stream of hot air is controlled in response to the ratio. The corresponding variant of the hair dryer is characterized in that the hair dryer comprises: means for measuring amounts of radiation energy in at least two absorption bands of radiation reflected from the hair, one of the absorption bands being caused by moisture in the hair and another one of the absorption bands being caused by a moisture-independent characteristic of the hair, means for determining the ratio between the amounts of radiation energy in the at least two absorption bands, and means for controlling the stream of hot air in response to the ratio.

The amount of moisture in the hair is now determined by comparing the absorption bands of water with a fixed reference band, preferably the absorption band of keratin. Keratin is a water-insoluble substance forming the principal constituent of the hair. During hair drying the reflection of the hair changes as a result of the decreasing amount of water, while the reflection of the keratin in the hair remains constant because the amount of keratin remains constant. The absolute value of the reflection as a result of water is, in itself, not always a reliable measure of the amount of water in the hair because the absolute value also depends on the distance between the hair and the sensor by means of which the amount of radiation is measured and on the intensity and the spectrum of the radiation source which emits the radiation to the hair. The absolute value of the reflection by the keratin depends on the distance and on the radiation source in a similar manner. Since the amount of keratin does not change during the drying process the ratio between the amounts of radiation in an absorption band of water and an absorption band of keratin is a good measure of the moisture content of the hair. By means of the measured moisture content the temperature and/or the strength of the air stream can be controlled so as to obtain an optimum result.

Water and keratin each have characteristic absorption bands in the spectrum of the reflected radiation. The absorption bands should not overlap one another and preferably lie in a spectral range which can be measured by means of one conventional type of sensor. The water absorption band around 1420 nm and the keratin absorption band around 2058 nm are suited and lie within the near infrared region which can be detected by means of PbS photoconductive sensors.

The hair is preferably irradiated by means of an infrared light source having optical focusing means arranged on the hair dryer. However, other light sources, which happen to be present or which have been installed intentionally for this purpose in the proximity of the hair to be dried can also be used provided that they emit energy in the relevant absorption bands. A suitable light source is an infrared halogen lamp having a continuous spectrum or a system of light sources having a narrow spectrum and a high spectral emission in the absorption bands to be measured.

By modulating the intensity of the light source, for example by chopping the light by means of a rotating filter wheel in the light path of the light source, it is possible, at the detection side, to make a distinction between reflection as a result of undesired background radiation and reflection as a result of the light source.

In order to enable the amount of radiation energy in the at least two different absorption bands to be measured, spectral selection is required. For this purpose, the reflected radiation can be focused onto a diffraction grating by means of a lens system, which grating diffracts the spectrum of the radiation in dependence upon the wavelength. The grating is followed by sensors arranged at suitably selected positions corresponding to the absorption bands to be measured.

BRIEF DESCRIPTION OF THE DRAWINGS

These and other aspects of the invention will be described and elucidated with reference to the accompanying drawings, in which.

In the Figures parts or elements having a like function or purpose bear the same reference symbols.

By utilizing the effect that water absorbs given wavelengths in the near-infrared radiation region to a greater extent than other wavelengths, it is possible to make a statement about the degree of moistness of the hair of the head. The absorption depends inter alia on the thickness of the layer of water on the hair. More infrared radiation will be absorbed as the layer of water increases in thickness. By irradiating the moist hair with infrared light the changing absorption in the spectrum reflected from the hair being dried can be measured by means of a sensor. The hair drying process can be controlled on the basis of such a measurement.

However, the problem may then be encountered that the absolute value of the reflected light energy depends not only on the amount of water in the hair but also on the distance between the sensor and the hair and on the amount of light from the light source. This problem can be solved by also measuring the reflection from a substance which is characteristic of the hair and whose composition and quantity does not change during drying of the hair. The reflection from said substance then functions as a reference. The principal constituent of hair is a water-insoluble protein called keratin. The absorption of the infrared radiation by keratin changes hardly during the drying process. Comparing the intensities of absorption bands of water with those of keratin yields a characteristic value which is a measure of the moistness of the hair. The spectrum reflected from water exhibits absorption bands in the near-infrared region around 935 nm, 1420 nm and 1930 nm. The spectrum reflected from keratin exhibits absorption bands around 1495 nm, 1690 nm, 1733 nm and 2058 nm.

DESCRIPTION OF THE PREFERRED EMBODIMENTS

Figure 1:
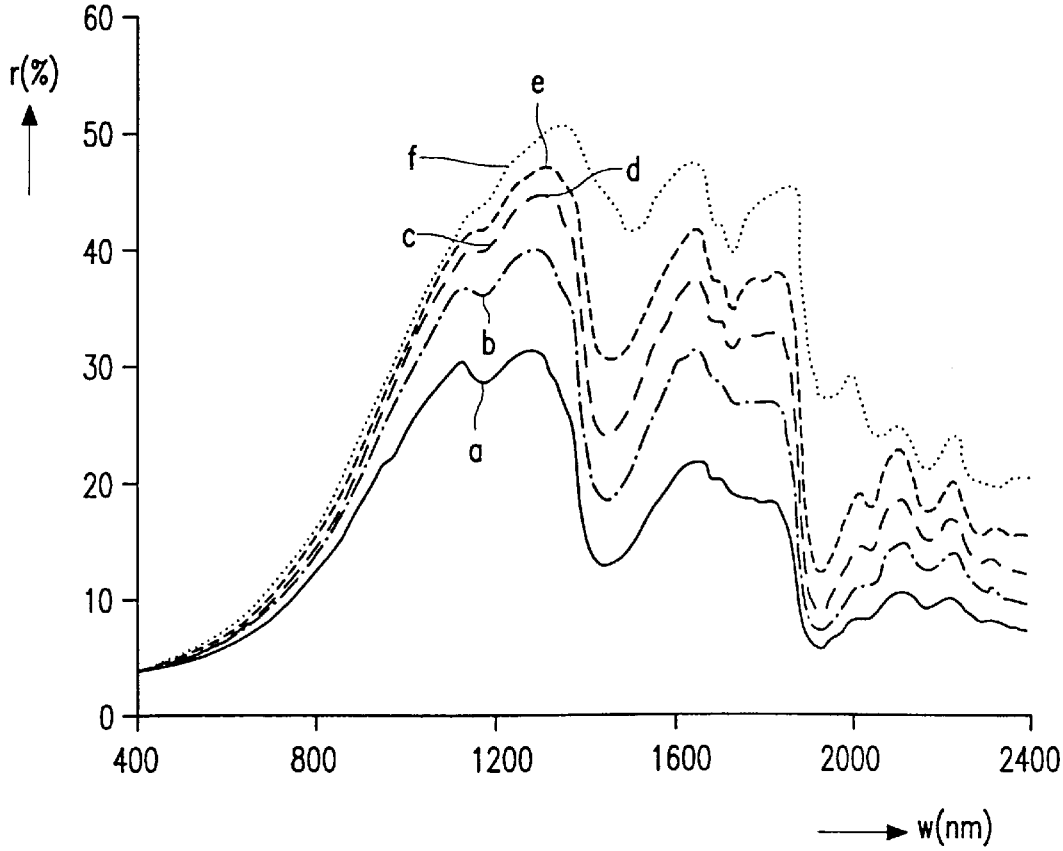
FIG. 1 represents the spectral reflection in the near-infrared spectrum for hair with a varying degree of moistness.

FIG. 1 represents the reflection r from dark blond hair as a function of the wavelength w between 400 and 2400 nm. Curve a relates to moist hair, the intermediate curves b, c, d and e relate to decreasingly moist hair, and curve f relates to dry hair. At 1420 nm there is a distinct dip as a result of water in the hair. This dip becomes smaller as the hair becomes drier. At 1930 nm a second dip is visible, also as a result of water in the hair. At 2058 nm a dip is visible, which is the result of absorption by keratin. Measuring the amount of radiation energy around one of the dips as a result of water, for example at 1420 nm, by means of a first sensor, measuring the radiation energy around one of the dips as a result of keratin, for example at 2058 nm, by means of a second sensor, and dividing the measurement results by one another, now yields a ratio which is a measure of the moisture content of the hair. Other types of hair, such as black hair or grey hair, yield curves having a different shape but having dips at the same positions in the reflected spectrum.

The desired absorption bands must be selected from the reflected spectrum. This can be effected, for example, by means of a diffraction grating having a grating constant of 4 micrometers, on which the reflected infrared light is focussed. The grating is followed by the sensors arranged at positions which correspond to the spectral bands to be measured. The hair is illuminated by means of an infrared light source having focussing means, for example a 50 W tungsten halogen lamp having a filament temperature of 2269 K, but any other light source with spectral emission in the absorption bands to be measured is suitable for this purpose.

In order to enable a distinction to be made between undesired background radiation and the desired radiation resulting from irradiation of the hair by means of the infrared light source, preferably the intensity of the light source is modulated, for example by chopping the light by means of a rotating filter wheel which is driven by an electric motor. In practice, a chopping frequency of 600 Hz appears to be satisfactory. The reflected radiation then contains a static component, as a result from the background radiation, and a modulated component, as a result of chopping of the light source. In the received sensor signal the modulated signal component can be isolated from the static component by means of a band-pass filter and can subsequently be processed. Instead of chopping it is also possible to turn on and turn off the light source itself if the properties of the light source allow this or make this possible.

The sensors by means of which the reflected radiation is measured should be sensitive in the near-infrared region and should deliver an adequate signal. Photoconductive sensors using lead sulphide (PbS) are suitable for this purpose.

Figure 2:
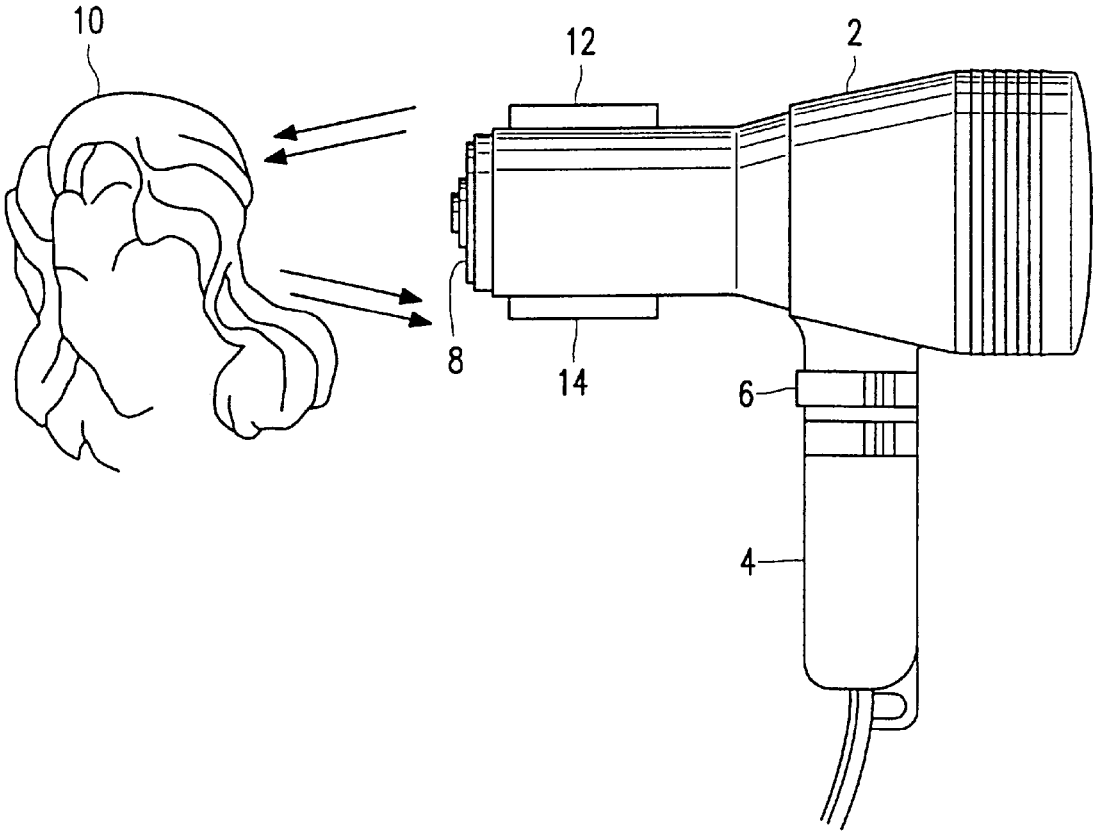
FIG. 2 shows a hair dryer with moistness sensing in accordance with the invention.

FIG. 2 shows a hair dryer which features moistness measurement using the principle described hereinbefore. The hair dryer has a housing 2 having a grip 4 on which an actuating switch 6 is situated. The housing accommodates (not shown) a heating element, a fan and electronic control devices with associated power supply. The air drawn in by the fan and heated by the heating element leaves the housing at an outlet opening 8 and heats the hair 10 to be dried. At a suitably selected location the housing 2 carries an infrared light source 12 and a detector 14. The light source 12 projects infrared light onto the hair 10. The light reflected from the hair 10 is received in the detector 14, which includes the sensors for measuring the amounts of radiation energy in the absorption bands of water and keratin. The detector 14 eventually supplies a signal RS which indicates the ratio between the amounts of energy measured in the spectral bands of water and keratin.

Figure 3:
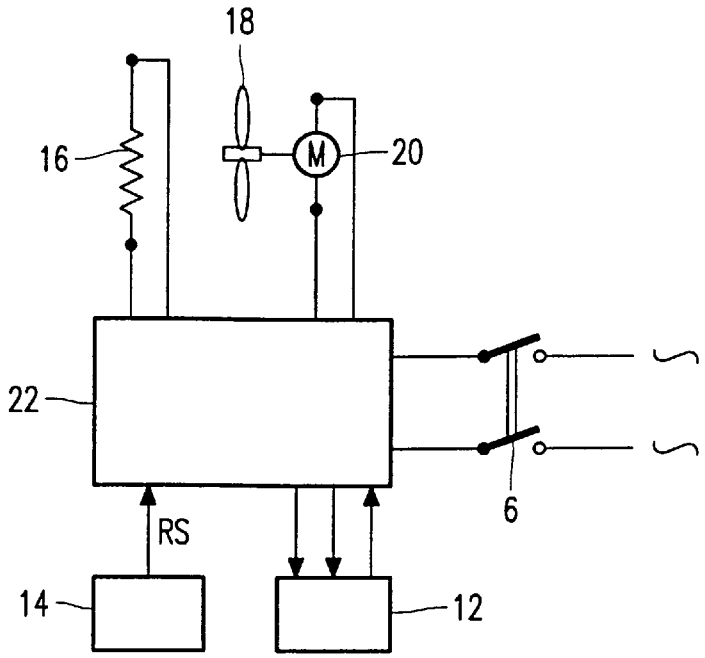
FIG. 3 is an electrical block diagram of a hair dryer in accordance with the invention.

FIG. 3 shows an electrical block diagram of the hair dryer. The heating element 16 heats air which is blown past the heating element 16 by means of a fan 18, which is driven by a motor 20. The power of the heating element 16 and/or the speed of the motor 20 is/are controlled by a control unit 22 on the basis of the signal RS from the detector 14. Thus, it is possible to reduce the power of the heating element when the moistness of the hair decreases, i.e. at a given value of the signal RS, in order to prevent the hair from becoming too dry or from being scorched. Furthermore, the control unit 22 communicates also with the light source 12 in order to control and, if necessary, synchronize a chopper or another modulation means.

Figure 4:
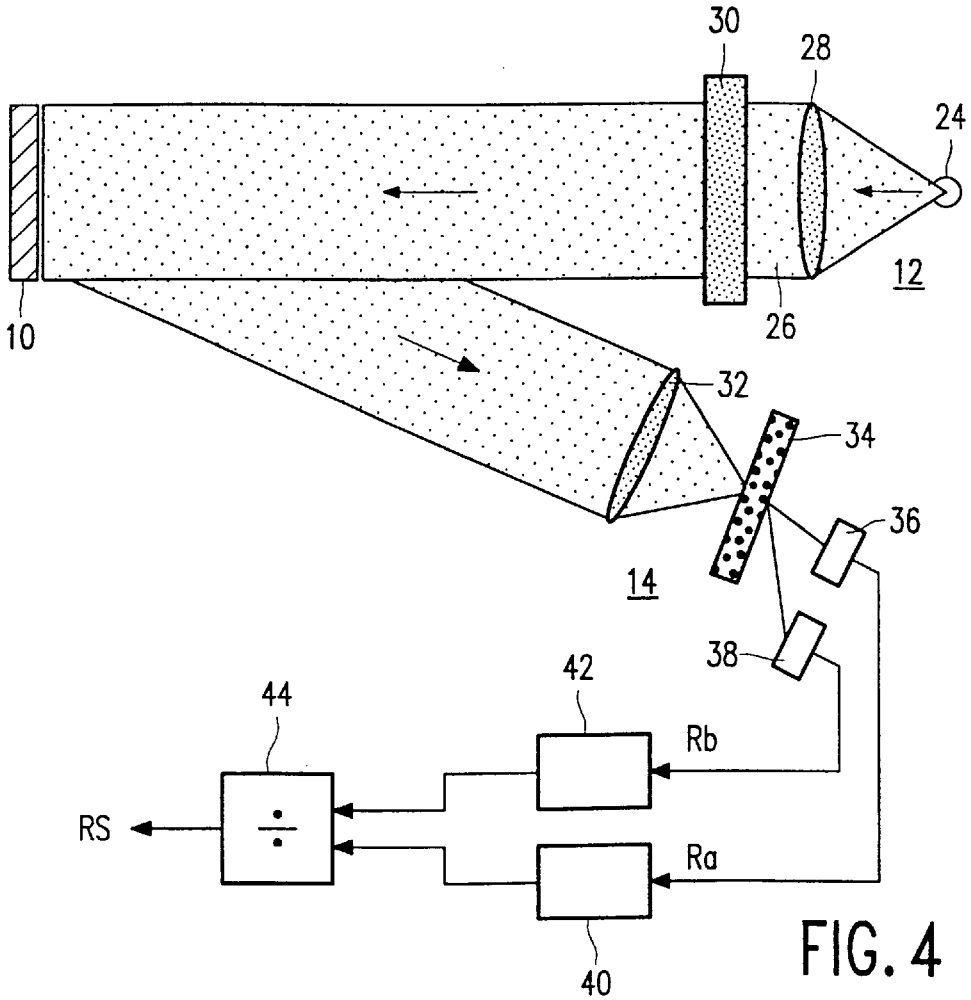
FIG. 4 shows a measurement system for remote sensing of the moistness of hair.

FIG. 4 shows an implementation of the light source 12 and the detector 14 in a simplified manner and not to scale. The light source 12 comprises an infrared lamp 24 whose radiation energy is focussed by means of a lens 28 so as to from a light beam 26. The light beam 26 is periodically interrupted by means of a chopper 30. The hair 10 reflects the light beam 26. A part of the reflected light beam is received by the detector 14. The detector 14 comprises a lens 32, which focuses the received light beam onto a diffraction grating 34, which provides the spectral separation of the absorption bands to be measured. The sensors 36 and 38 are arranged after the diffraction grating 34, one of the sensors, the sensor 36, supplying a signal Ra which is a measure of the amount of radiation energy in the absorption band around 1420 nm, and the other sensor, the sensor 38, supplying a signal Rb which is a measure of the amount of radiation energy in the absorption band around 2058 nm. However, it is likewise possible to use more sensors in order to analyze even more characteristic dips in the received light beam. The signals Ra and Rb are amplified, filtered and demodulated in respective signal processing circuits 40 and 42 and are applied to a signal divider 44, which divides the signals Ra and Rb by one another and supplies the signal RS which is a measure of the ratio Ra/Rb of the spectral energies in the measured absorption bands. Amplification, filtering and demodulation are customary techniques in the field of electronics. Dividing two signals can be effected, for example, by means of a log/antilog amplifier. Certain functions can also be performed in the digital domain after the analog signals have been digitized by means of analog-to-digital converters.

When the sensor 38, the signal processing circuit 40 and the signal divider 44 are dispensed with, a system is obtained which is based on an absolute measurement of the amount of energy in the absorption band around 1420 nm.

I claim:

1. Method of drying hair by supplying hot air, using remote sensing of the moisture content of the hair, wherein amounts of radiation energy in at least one absorption band of radiation reflected from the hair are measured, the at least one absorption band being caused by the moisture content of the hair and the change of the amount of radiation energy in the at least one absorption band being used as a measure of the change of the amount of the moisture content, and the stream of hot air is controlled in response to the change.

2. A method of drying hair by supplying hot air, using remote sensing of the moisture content of the hair, wherein amounts of radiation energy in at least two absorption bands of radiation reflected from the hair are compared with one another, one of the absorption bands being caused by moisture in the hair and another one of the absorption bands being caused by a moisture-independent characteristic of the hair, the ratio between the amounts of radiation energy in the at least two absorption bands being used as a measure of the moisture content, the stream of hot air being controlled in response to the ratio.

3. A method as claimed in claim 2, wherein the other one of the absorption bands is caused by keratin in the hair.

4. A method as claimed in claim 2, wherein the one absorption band is situated around 1420 nm and the other absorption band is situated around 2058 nm.

5. A method as claimed in claim 2, wherein the hair is irradiated by means of an infrared light source whose intensity is modulated.

6. A method as claimed in claim 2, wherein the radiation reflected from the hair is focused onto a grating by means of a lens and the amounts of radiation energy are measured by means of sensors arranged at that side of the grating which is remote from the lens.

7. A hair dryer including means for supplying a stream of hot air for drying moist hair and means for the remote sensing of the moisture content of the hair, wherein the hair dryer comprises: means for measuring amounts of radiation energy in at least one absorption band of radiation reflected from the hair, the at least one absorption band being caused by the moisture content of the hair, means for determining the change of the amount of radiation energy in the at least one absorption band, the chance of the amount of radiation energy in the at least one absorotion band being used as a measure of the change of the amount of the moisture content, and means for controlling the stream of hot air in response to the change.

8. A hair dryer including means for supplying a stream of hot air for drying moist hair and means for the remote sensing of the moisture content of the hair, wherein the hair dryer comprises: means for measuring amounts of radiation energy in at least two absorption bands of radiation reflected from the hair, one of the absorption bands being caused by moisture in the hair and another one of the absorption bands being caused by a moisture-independent characteristic of the hair, means for determining the ratio between the amounts of radiation energy in the at least two absorption bands, and means for controlling the stream of hot air in response to the ratio.

9. A hair dryer as claimed in claim 8, wherein the other one of the absorption bands is caused by keratin in the hair.

10. A hair dryer as claimed in claim 8, wherein the one absorption band is situated around 1420 nm and the other absorption band is situated around 2058 nm.

11. A hair dryer as claimed in claim 8, wherein the hair dryer includes an infrared light source for irradiating the hair, and means for modulating the intensity of the light source.

12. A hair dryer as claimed in claim 8, wherein the hair dryer further includes: a grating, a lens for focussing the radiation reflected from the hair onto the grating, and sensors, arranged at that side of the grating which is remote from the lens, for measuring the amounts of radiation energy.

* * * * *